US005662466A

United States Patent [19]

Cheng

[11] Patent Number: 5,662,466

[45] Date of Patent: Sep. 2, 1997

[54] SAFETY STRUCTURE FOR ELECTRONIC LIGHTERS

[76] Inventor: Mei-Jung Cheng, 2F, No. 3-1, Alley 15, Lane Shui Ching, Peitun District 406, Taichung City, Taiwan

[21] Appl. No.: 635,261

[22] Filed: Apr. 12, 1996

[51] Int. Cl.[6] ..... F23D 11/36

[52] U.S. Cl. ..... 431/153; 431/255

[58] Field of Search ..... 431/153, 255

[56] References Cited

U.S. PATENT DOCUMENTS 5,558,514 9/1996 Ansquer ..... 431/153

*Primary Examiner*—Carroll B. Dority
*Attorney, Agent, or Firm*—Bacon & Thomas

[57] ABSTRACT

A safety structure for electronic lighters. The safety structure includes two corresponding press posts and a press block vertically disposed inside a hollowed frame at the bottom side of a press means pivotally disposed on an upper cover, the cover having an inner wall provided with corresponding retain bosses and accommodating a safety button. The safety button has a push block located at a rear notch of the upper cover, and the push block is provided with a rectangular urge plate and an L-shaped rod. Under normal circumstances, the urge plate is located at the bottom edge of a rear plate of the frame for stopping the downward displacement of the press means, and the L-shaped rod is located a suitable distance from the press post. The post is provided with two positioning bosses for matching the retain bosses. A partition is disposed inside a housing for defining two spaces for accommodating a nozzle means and an igniter respectively. A projecting plate and a resilient strip are disposed in the space containing the igniter. The resilient strip has one end fitted into a slot of the safety button and may be used to assist return displacement of the safety button. The safety button may be pushed forwardly or released to control the press means so as to prevent inadvertent ignition.

5 Claims, 4 Drawing Sheets

SAFETY STRUCTURE FOR ELECTRONIC LIGHTERS

BACKGROUND OF THE INVENTION (a) Field of the Invention

The present invention relates to a lighter, and more particularly to an electronic lighter with a safety structure.

(b) Description of the Prior Art

Conventional electronic lighters are usually not provided with any safety mechanism, and fire accidents may easily result when children play with them.

SUMMARY OF THE INVENTION

Accordingly, a primary object of the present invention is to provide a safety structure for electronic lighters.

In order to achieve the above-mentioned object, the present invention comprises a housing containing liquefied gas, the housing having its interior divided by a partition into respective spaces for accommodating a nozzle means and an electronic igniter, an upper side of the housing having an upper cover fitted thereon and a press means pivotally disposed thereon, the upper cover having two corresponding side walls at an upper side thereof near a front rim thereof, the two side walls having corresponding pivot holes respectively, the upper cover further having a notch at a rear end thereof and a safety button mounted therewithin, wherein the housing is provided with a projecting plate and a resilient piece at the space containing the electronic igniter; the upper cover has corresponding retain bosses; the press means having a trigger press portion, the press portion having a hollowed frame disposed at a botton side thereof, and two corresponding press posts, a press block and a stop plate vertically disposed therein, a pivot portion being mounted at a front side of the frame, the pivot portion being pivotally provided at the pivot holes of the side walls; and the safety button has a push block accommodated in the notch at the rear end of the upper cover, the push block having a rectangular urge plate and an L-shaped rod respectively and vertically disposed at a front side thereof, the L-shaped rod having two horizontal portions each of which has a positioning boss provided on an upper surface thereof, each of the horizontal portions bending upwardly to form a vertical urge post, and a slot being formed at a predetermined position at a bottom side of the safety button for receiving and positioning one end of the resilient strip.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
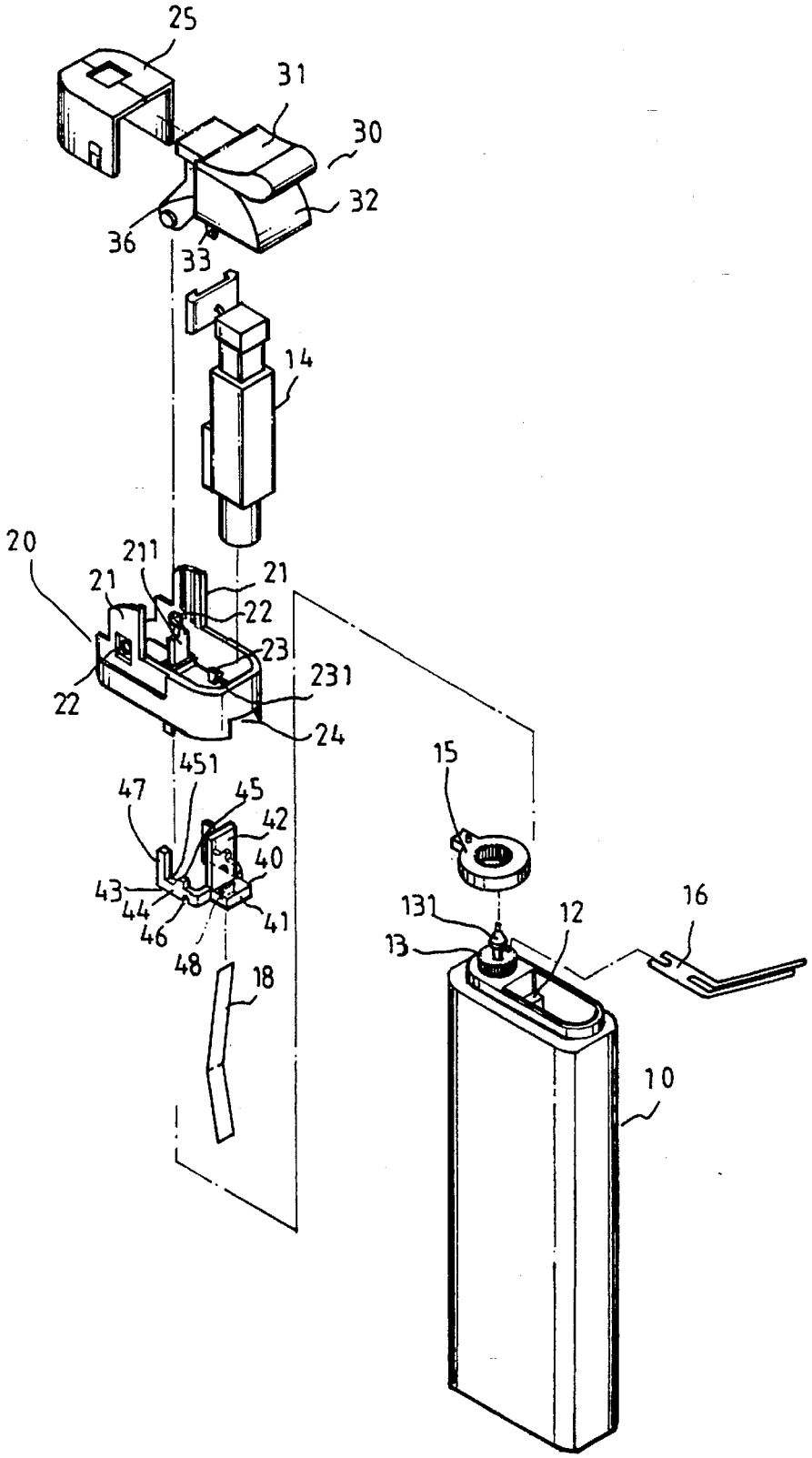
FIG. 1 is an elevational exploded view of a preferred embodiment of the present invention.
Figure 2:
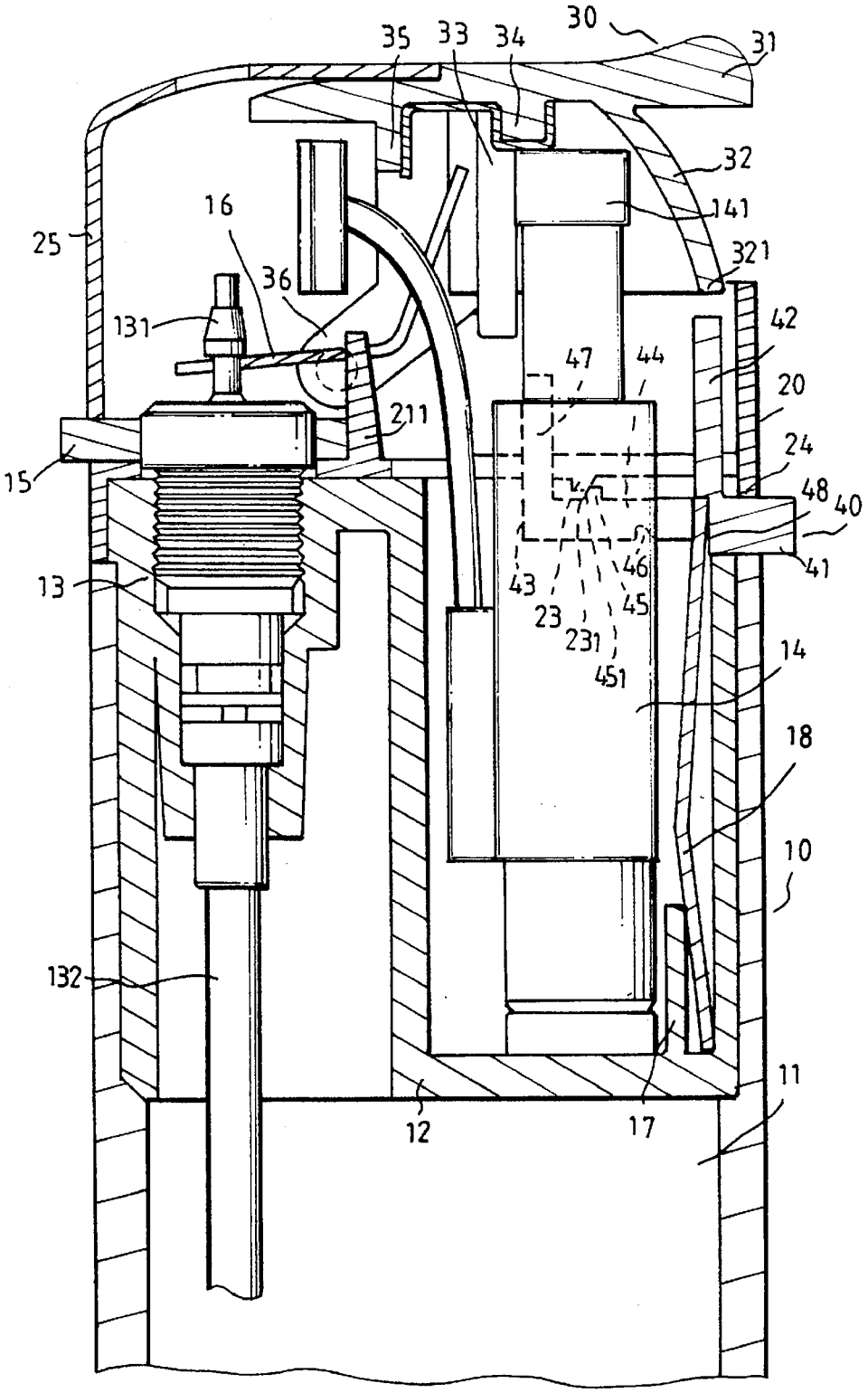
FIG. 2 is a sectional view of the preferred embodiment.

With reference to FIGS. 1 and 2, the safety structure for electronic lighters of the present invention comprises a housing 10, an upper cover 20, a press means 30 and a safety press button 40.

The housing 10 contains liquefied gas 11, and a partition 12 near an upper end thereof divides its interior into spaces respectively for accommodating a nozzle means 13 and an electronic igniter 14. The nozzle means 13 has a nozzle 131 which is connected to a suction tube 132 at a bottom end thereof and is fitted with a flow adjusting ring 15 for adjusting the liquefied gas flow through the nozzle 131 and a lever for controlling the opening or closing of the nozzle 131 at a top side thereof. The lever 16 has front and rear forks and a slightly bent middle portion. The front fork of the lever 16 is located at the bottom end of the nozzle 131. In the space accommodating the electronic igniter 14 is provided a projected plate 17 and is insertably provided a resilient strip 18, the resilient strip 18 substantially resembling the shape of "<". As for the electronic igniter 14, it is well known in the art and will not be described in detail herein.

The upper cover 20 is fitted onto the upper end of the housing 10. It is provided with two corresponding side walls 21 at an upper side thereof adjacent to a rear end; the two side walls 21 respectively have through holes 22. A post 211 is vertically disposed on the upper side of the upper cover 22, and corresponding retain bosses 23 are also provided in the proximity. The lever 16 has its rear fork fitted onto the post 211. The rear side of each retain boss 23 is configured to be an inclined surface 231. A rear side of the upper cover 20 is provided with an opening 24, and a nozzle cap 25 is fitted around the two side walls 21.

The press means 30 is pivotally provided on the side walls of the upper cover 20 and has a press portion 31 capable of being triggered by hand. The press portion 31 is provided with a hollowed frame 32 at a bottom side thereof, and two corresponding press posts 33, a press block 34 and a stop piece are vertically disposed in its interior. In addition, a pivot portion 36 is mounted at a front side of the frame 32, the pivot portion 36 being pivotally provided at the pivot holes 22 of the side walls 21.

The safety button 40 is fitted into an inner ring of the upper cover 20 and is provided with a push block 41 which maybe accommodated in the notch 24 at the rear side of the upper cover 20. The push block 41 has a rectangular urge plate 42 and an L-shaped rod 43 respectively and vertically provided in front thereof. The L-shaped rod 43 has two horizontal portions 44 each of which has a positioning boss 45 formed at an upper surface thereof. The positioning bosses 45 is provided with an inclined surface 451 at a front side thereof, and a notch of enlarged compression resilience is provided at a bottom side thereof. The respective horizontal portion 44 has an extreme end thereof bending upwardly to form a vertical urge post 47, and a slot 48 is formed at a predetermined position at the bottom side of the safety button 40 for receiving and positioning the resilient strip 18 inserted therein.

The components as well as their relative positions of the invention have been described as above. Assembly of the components will be described hereinbelow.

With reference to FIG. 2, the nozzle means 13 and the electronic igniter 14 are respectively fitted into the housing 10, and the resilient strip 18 has one end thereof engaging the projected plate 17 in the electronic igniter 14. The safety button 40 is then disposed above the housing 10 so that the resilient strip 18 has its other end fitted into the notch 48 at the bottom side of the safety button 40. The upper cover 20 is then fitted onto the top side of the housing 10. At this point, the retain bosses 23 at the inner wall of the upper cover 20 are in engagement with the positioning bosses 45 on the L-shaped rod 43 of the safety button 40 so that they are positioned. That is, the inclined surfaces 231 at the rear side of the retain bosses 23 respectively abut the inclined surfaces 451 at the front side of the positioning bosses 45 for restriction purposes. Then the flow adjusting ring 15 and the lever 16 are respectively mounted to the bottom side of the nozzle means 13. At the same time, the rear fork of the lever 16 is located above the post 211 of the upper cover 20, i.e., the pivot portion 36 of the press means 30 is utilized to be pivotally provided at the pivot holes 22 of the side walls 21 of the upper cover 20, such that the press means 30 may rotate with the pivot portion 36 as its pivot when being pressed, while the press block 34 located at the hollowed frame 32 of the press means 30 urges against an upper portion of a switch 141 of the electronic igniter 14. Under normal circumstances, the bottom edge of a rear plate 321 of the hollowed frame 32 is located above the urge plate 42 of the safety button 40, stopping the downward rotary displacement of the press means 30. Additionally, the vertical urge post 47 of the L-shaped rod 43 of the safety button 40 is located a suitable distance from a lower portion of the press post 33 of the press means 30.

Figure 3:
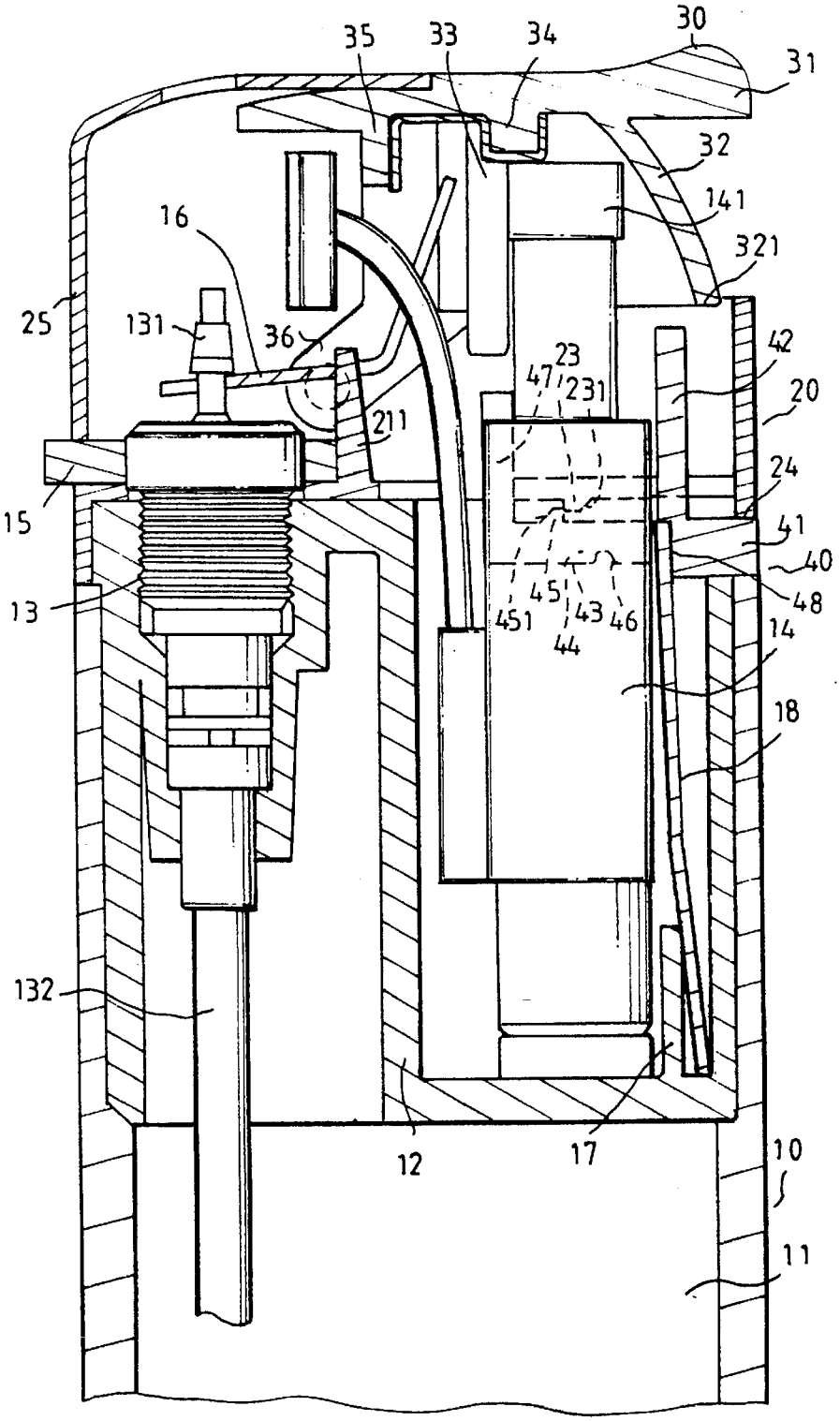
FIG. 3 is a schematic view of the preferred embodiment, illustrating a safety button of the invention in a pressed state.
Figure 4:
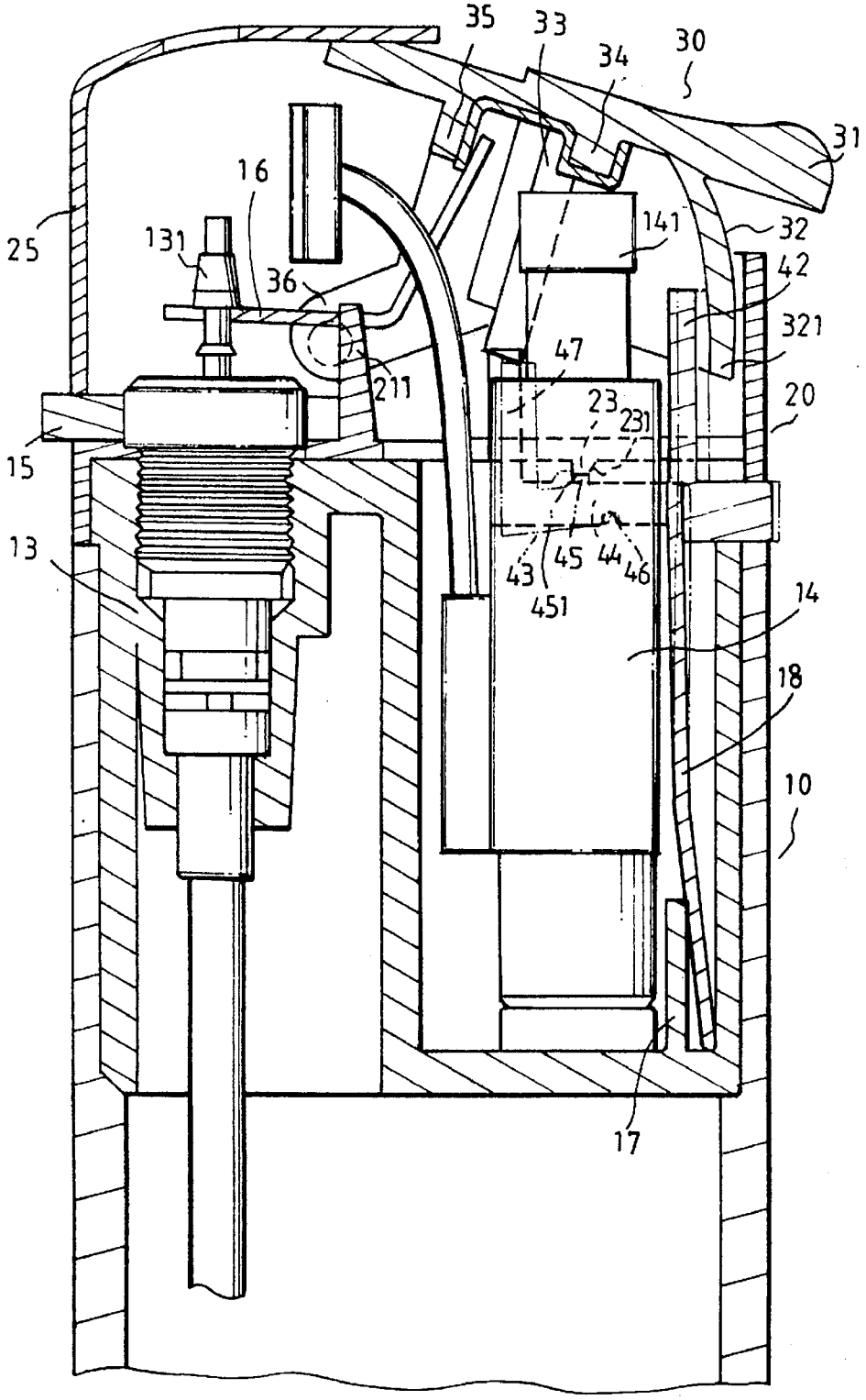
FIG. 4 is a schematic view of the preferred embodiment, illustrating a press means of the invention in a pressed state.

Operation of the lighter of the invention is illustrated in FIG. 3. At first, the push block 41 of the safety button 40 has to be moved in the direction of the inner side of the housing 10 so that the inclined surfaces 231 of the retain bosses 23 and the inclined surfaces 451 of the positioning bosses 45 previously abutting each other urge upwardly and slidably displace so that the positioning bosses 45 cross above the retain bosses 23 and are located at the front end of the retain bosses 23, and the vertical post 47 of the L-shaped rod 43 displaces forwardly to just below the press post 33 of the press means 30, while the urge plate 42 simultaneously displaces forwardly to move a suitable distance away from the bottom edge of the rear plate 321 of the hollowed frame 32. Reference is now made to FIG. 4. As shown therein, the press portion 41 of the press means 30 may be pressed at this point so that the press means 30 uses the pivot portion 36 as its pivot to rotatably displace downwardly while the press block 34 at its bottom side press downwardly the switch 141 of the electronic igniter 14 and the stop plate 35 rotatably displaces downwardly to push the lever 16 such that the front fork of the lever 16 pushes upwardly to cause the nozzle to open to allow flow of liquefied gas 11. A flame will be lit by use of the electronic igniter 14. When the flame is being lit, the two press posts 33 of the press means 30 will also press downwardly against the vertical urge post 47 of the safety button 40 so that the positioning bosses 45 are separated from the retain bosses 23. After the flame is lit, once the user's finger is lifted from the press portion 31 of the press means 30, the press means will be subjected to the resilience of the switch 14 to reset to its original position. The lever 16 will also reset as a result of disappearance of pressure. The nozzle 131 closes and the safety button 40 resets as a result of the resilience of the resilient strip 18 at the bottom side thereof, i.e., the bottom edge of the rear plate 321 of the hollowed frame 32 is just located above the urge plate 42; the vertical urge post 47 is located a suitable distance from the lower portion of the press post 33, and the inclined surface 231 of the retain bosses 23 abuts the inclined surface 451 of the positioning bosses 45, as shown in FIG. 2.

In view of the aforesaid, according to the safety structure for electronic lighters of the present invention, it is not possible to press down the press means to lit a flame under normal circumstances. It is necessary to push the safety button before use. And after ignition, the safety mechanism will be in operation again, preventing other people, especially children, from lighting a flame when playing with the lighter.

Although the present invention has been illustrated and described with reference to the preferred embodiment thereof, it should be understood that it is in no way limited to the details of such embodiment but is capable of numerous modifications within the scope of the appended claims.

What is claimed is:

1. A safety structure for electronic lighters, comprising a housing containing liquefied gas, said housing having its interior divided by a partition into respective spaces for accommodating a nozzle means and an electronic igniter, an upper side of said housing having an upper cover fitted thereon and a press means pivotally disposed thereon, said upper cover having two corresponding side walls at an upper side thereof near a front rim thereof, said two side walls having corresponding pivot holes respectively, said upper cover further having a notch at a rear end thereof and a safety button mounted therewithin, wherein, said housing is provided with a projecting plate and a resilient piece at the space containing said electronic igniter;

said upper cover has corresponding retain bosses;

said press means having a trigger press portion, said press portion having a hollowed frame disposed at a bottom side thereof, and two corresponding press posts, a press block and a stop plate vertically disposed therein, a pivot portion being mounted at a front side of said frame, said pivot portion being pivotally provided at said pivot holes of said side walls; and said safety button has a push block accommodated in said notch at the rear end of said upper cover, said push block having a rectangular urge plate and an L-shaped rod respectively and vertically disposed at a front side thereof, said L-shaped rod having two horizontal portions each of which has a positioning boss provided on an upper surface thereof, each of said horizontal portions bending upwardly to form a vertical urge post, and a slot being formed at a predetermined position at a bottom side of said safety button for receiving and positioning one end of said resilient strip.

2. A safety structure as claimed in claim 1, wherein said resilient strip located in the space containing said electronic igniter has a shape resembling "<".

3. A safety structure as claimed in claim 1, wherein each of said retain bosses has an inclined surface at a rear side thereof.

4. A safety structure as claimed in claim 1, wherein each of said positioning bosses has an inclined surface at a front side thereof.

5. A safety structure as claimed in claim 1, wherein each of said horizontal portions of said L-shaped rod is provided with a slot of enlarged compression resilience.

* * * * *